US005562006A

United States Patent [19]

Pelosi, Jr. et al.

[11] Patent Number: 5,562,006

[45] Date of Patent: Oct. 8, 1996

[54] MANUAL WRENCH WITH GRIPPABLE MEMBER

[76] Inventors: Frank Pelosi, Jr.; Lee J. Pelosi, both of 32 Orchard La., Marlton, N.J. 08053

[21] Appl. No.: 332,167

[22] Filed: Oct. 31, 1994

[51] Int. Cl.[6] ..... B25B 13/02

[52] U.S. Cl. ..... 81/119; 81/177.1

[58] Field of Search ..... 81/119, 124.3, 81/124.7, 177.1, 177.2, 177.8, 177.85, 121.1

[56] References Cited

U.S. PATENT DOCUMENTS

| | | | |
|---|---|---|---|
| 564,625 | 7/1896 | Kelsea | 81/119 |
| 3,772,943 | 11/1973 | Itano | 81/119 |
| 3,783,717 | 1/1974 | Ramge | 81/119 |
| 3,897,702 | 8/1975 | Rovai | 81/119 |
| 5,287,775 | 2/1994 | Moore | 81/121.1 |
| 5,297,458 | 3/1994 | Smith et al. | 81/124.3 |

FOREIGN PATENT DOCUMENTS

| | | | |
|---|---|---|---|
| 840339 | 1/1939 | France | 81/177.2 |

*Primary Examiner*—James G. Smith
*Attorney, Agent, or Firm*—Norman E. Lehrer; Jeffrey S. Ginsberg

[57] ABSTRACT

A manual wrench includes a plate-like member having a plurality of substantially equally spaced projections extending around the periphery of the plate-like member. A slot is formed between two projections. A handle can be friction fitted over one of the radially extending projections for increasing the amount of leverage that can be applied to the wrench.

6 Claims, 2 Drawing Sheets

MANUAL WRENCH WITH GRIPPABLE MEMBER

FIELD OF THE INVENTION

The present invention is directed toward a manual wrench with a grippable member for raising and/or lowering a threaded leg or bolt extending from the bottom of a piece of furniture and, more particularly, to such a device comprising a disc-shaped member having an elongated slot formed therein and a plurality of projections extending around the periphery thereof. The wrench also includes a handle adapted for attachment to one of the projections.

BACKGROUND OF THE INVENTION

The use of modular furniture in office buildings has become quite common. It is utilized to conveniently create individual offices without requiring permanent walls. Modular furniture comprises a number of equally sized panels, each having a pair of hanging tracks secured to opposite sides thereof. Each hanging track includes a metal strip having a series of vertically coplanar elongated slots. Shelves, desks and the like are equipped with hooks that are designed to mate with the elongated slots. A number of legs extend from the bottom of each panel. In most instances the legs are threadably secured in the panels and have a foot secured to the bottom thereof.

The floor on which the furniture is placed is often covered with a number of carpet tiles. When the carpet tiles require replacement, the modular furniture has to be moved. This can be achieved by physically dismantling the furniture and moving the individual partitions from the area that has to be re-carpeted, laying down new carpet tiles and then returning the furniture to its original configuration.

A more efficient, cheaper and less disruptive way to re-carpet the floor is to individually thread a number of legs into the partitions so that the old carpet tiles can be removed and new ones installed. Since each of the individual panels generally has more than two legs, the panel can be supported by the at least two legs while a different leg is threaded up into the panel and off the ground.

Threading one of the legs up into the panel can be difficult as there is only a limited amount of space to grasp the leg. In addition, it is often hard to loosen the threaded connection between the leg and the panel. Accordingly, there is a need for a tool that can be inserted between the ground and the bottom of the panel to grasp and thread the leg up into the panel.

SUMMARY OF THE INVENTION

The present invention is designed to overcome the deficiencies of the prior art discussed above. It is an object of the invention to provide a manual wrench with a grippable member adapted to be secured around a leg or bolt that extends from the bottom of a piece of modular furniture.

It is a further object of the invention to provide such a wrench that has a number of radially extending projections for facilitating the tightening or loosening of the threaded connection between the leg and the piece of modular furniture.

It is yet another object to provide such a wrench equipped with a handle to provide increased leverage.

In accordance with the illustrative embodiments and demonstrating features of the present invention there is provided a manual wrench which includes a plate-like member having a plurality of projections extending around its periphery and a slot formed between two adjacent projections. A handle can be friction fitted over one of the projections in order to provide the plate-like member with increased leverage.

BRIEF DESCRIPTION OF THE DRAWINGS

For the purpose of illustrating the invention, there is shown in the accompanying drawings one form which is presently preferred; it being understood that the invention is not intended to be limited to the precise arrangements and instrumentalities shown.

DETAILED DESCRIPTION OF THE PREFERRED EMBODIMENT

Figure 1:
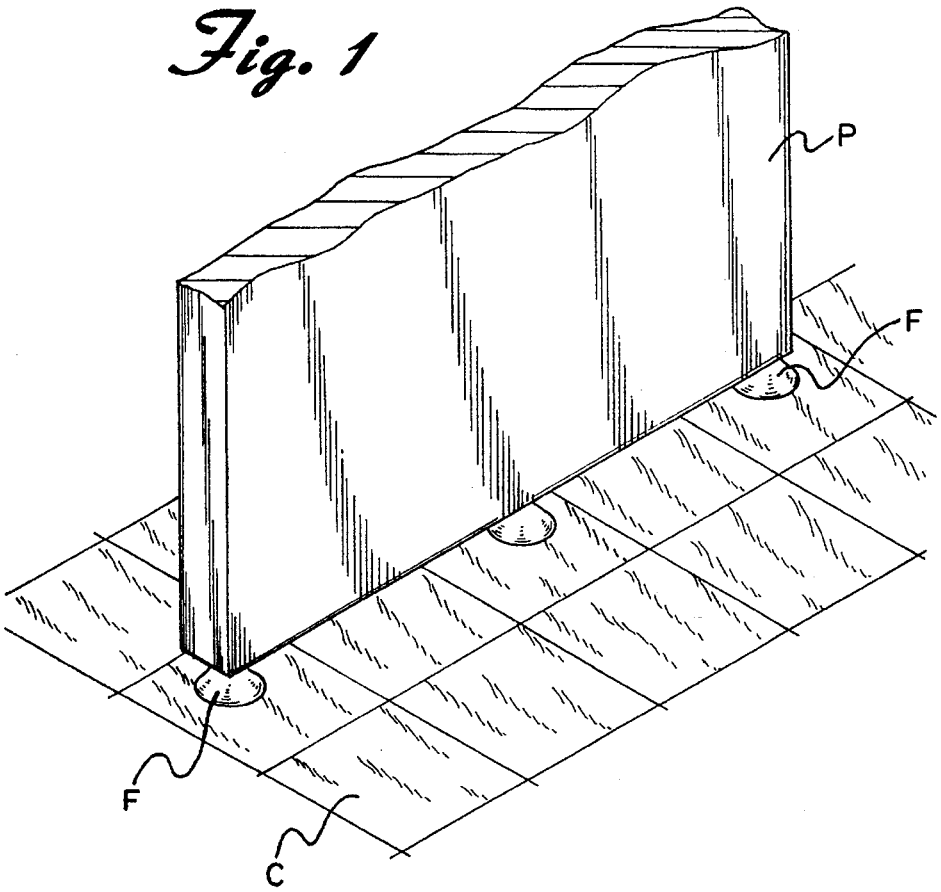
FIG. 1 is a perspective view of a furniture panel and several depending legs.

Referring now to the drawings in detail wherein like reference numerals have been used throughout the various figures to designate like elements, there is shown in the figures a manual wrench with a grippable member constructed in accordance with the principles of the present invention and designated generally as 10.

Referring to FIGS. 3–6, the manual wrench 10 comprises a plate-like member 12 having a plurality of equally spaced projections 14 extending around the periphery thereof and a handle 16. A notch 13 is formed between each of the projections 14. The notches are sized so that the user of the wrench can partially insert his or her fingers between the projections 14 and sufficiently grip the plate-like member 12.

In the preferred embodiment, the plate-like member 12 is disc shaped. The member 12 with the projections 14 preferably has a diameter of about 5" (13 cm) and a thickness of ⅛" (0.30 cm). In addition, the plate-like member 12 is preferably made of a low carbon steel. However, the member 12 can be made of a variety of other materials.

An elongated slot 18 is formed in the member 12 between two adjacent projections 15 and 17. The slot 18 has substantially parallel side walls and is sized to engage the flat segment S formed on a threaded leg L secured in a piece of modular furniture M in the manner described below. To ensure sufficient engagement with the flat segment S on the leg L, the slot preferably extends into the plate-like member 12 a distance which slightly exceeds the radius of said member. The slot is, therefore, preferably an elongated U-shape having a length of about 2.5" (6.4 cm) and in the preferred embodiment a width of ⅜" (0.10 cm).

The adjacent projections 15 and 17 each have a side 20 and 22, respectively, that diverges from one another outwardly from plate-like member 12. The diverging projections 20 and 22 facilitate the insertion of the slot 18 around leg L. More specifically, the diverging sides of the projections 15 and 17 act as a guide for the slot 18.

A handle 16 has one end 19 that is removably securable to one of the projections 14. In the preferred embodiment, the end 19 is friction fitted over one of the projections 14. The handle 16 increases the amount of leverage that can be applied to the plate-like member so that the leg L can be loosened from a tight threaded connection between itself and the piece of modular furniture M. The handle 16 is preferably 7" (18 cm) long.

To facilitate an understanding of the principles associated with the foregoing apparatus, its operation will now be briefly described. The slot 18 formed in the plate-like member 12 is inserted around a leg L extending from the bottom of a piece of modular furniture M so as to engage the flat segment S formed on the leg L (see FIGS. 3 and 4). The angle of the projections 15 and 17 facilitate the guiding of the leg L into slot 18. Next, the end 19 of the handle 16 is friction fitted over one of the projections 14. The user then grasps the handle 16 to rotate the member 12 clockwise or counter-clockwise in order to loosen the threaded connection between the leg L and the piece of modular furniture M.

Figure 2:
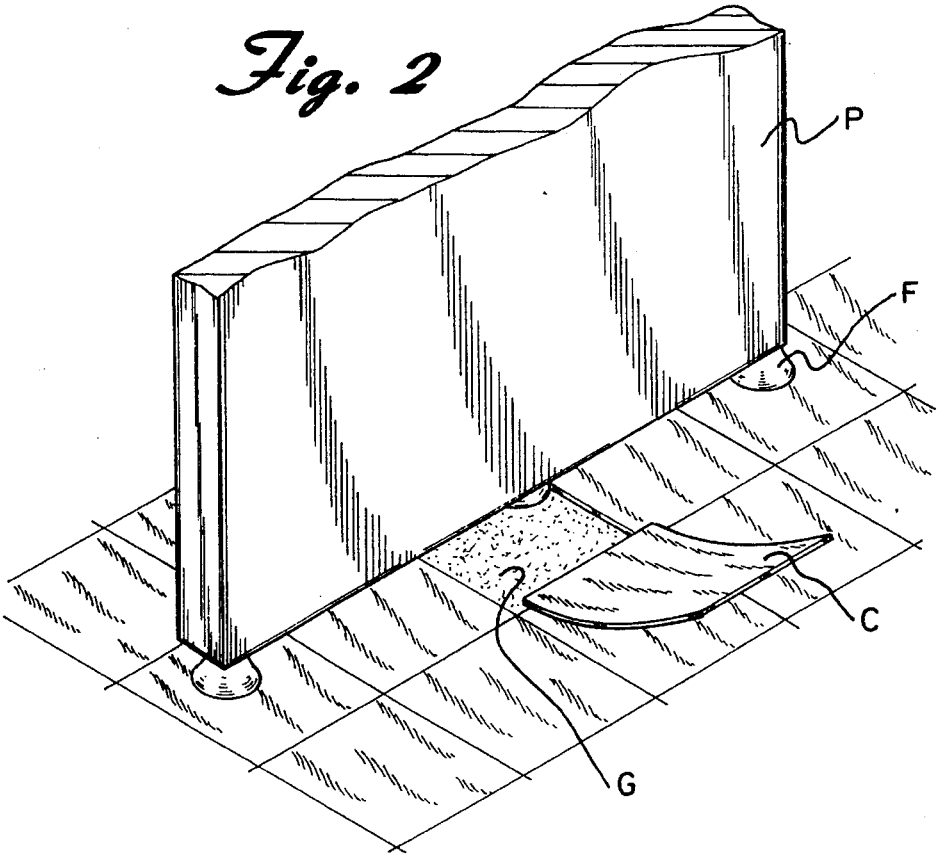
FIG. 2 is a perspective view similar to FIG. 1 but showing one of the legs threaded up into the panel.
Figure 3:
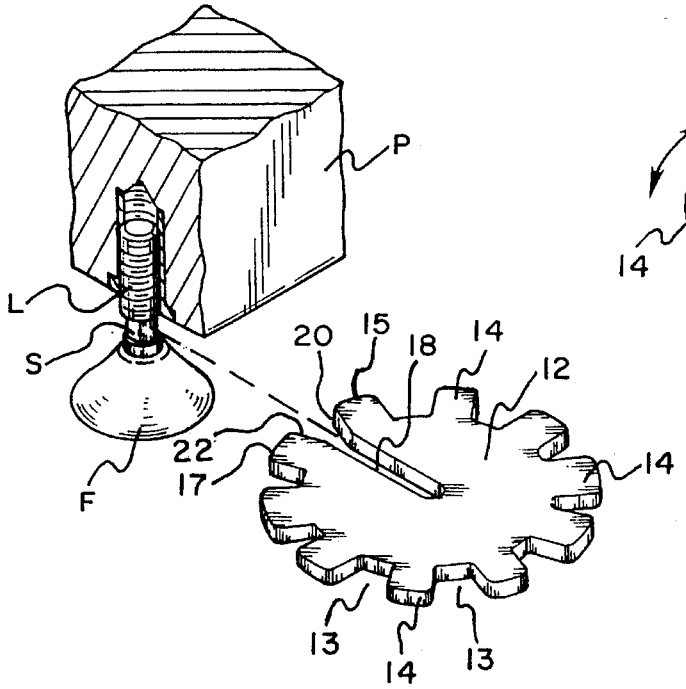
FIG. 3 is a sectional view of one of the legs shown threaded in the panel.
Figure 4:
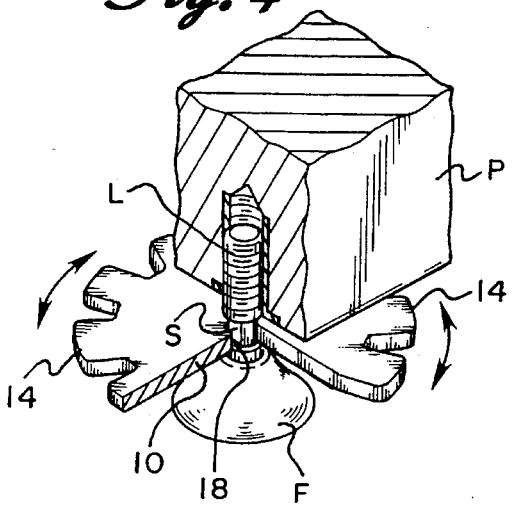
FIG. 4 is a sectional view of the manual wrench of the present invention engaging the leg.
Figure 5:
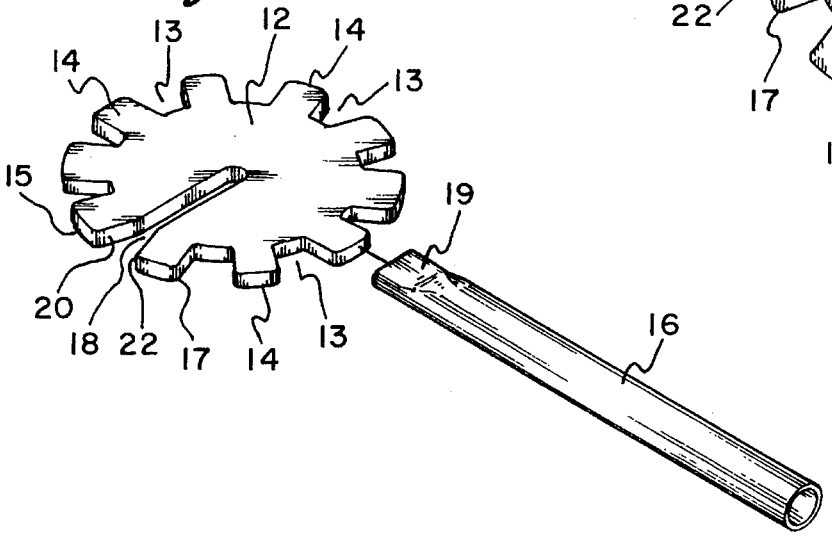
FIG. 5 is a perspective view of the manual wrench showing the handle disengaged from the disc-shaped member.
Figure 6:
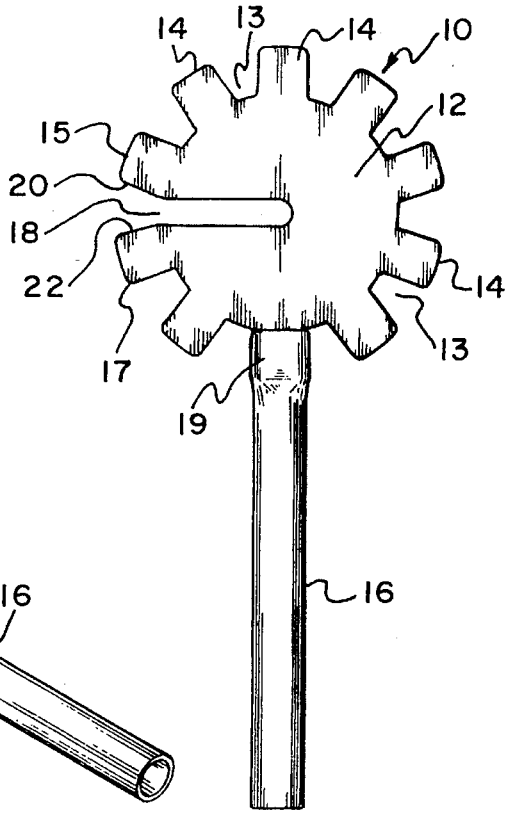
FIG. 6 is a plan view of the manual wrench with the handle engaged.

Once the threaded connection is broken, the handle 16 is removed from the plate-like member 12. The user then grasps the plate-like member 12 between the projections 14 and turns the member in the direction (clockwise or counterclockwise) that threads the leg L and attached foot F up into the piece of modular furniture M. The piece of modular furniture M generally has more than two legs. Accordingly, the piece of furniture is supported by the other legs that remain on the ground (see FIG. 2). When one of the legs L is threaded up into the piece of furniture and the attached foot F is raised off the ground, carpet tile C located immediately below the foot can be replaced with a new piece of carpet tile. After the change of the carpet tile has been carried out, the operator rotates the member so that the leg is unthreaded from the piece of furniture and the attached foot once again contacts the ground.

While the present invention has been specifically described for use in turning a leg extending from the bottom of a furniture panel, it should be understood that the same is not limited thereto. A similar wrench can be used to turn any threaded device having a flat segment such as a bolt or nut. In such a case, the width of the slot would be substantially equivalent to the diameter or width of the bolt head or nut.

The present invention may be embodied in other specific forms without departing from the spirit or essential attributes thereof and accordingly reference should be made to the appended claims rather than to the foregoing specification as indicating the scope of the invention.

We claim:

1. A manual wrench for engaging a threaded member having a flat segment comprising:

a plate-like member;

a plurality of substantially equally spaced projections extending around the periphery of said plate-like member;

a plurality of notches extending around the periphery of said plate-like member, each of said notches being defined by two corresponding adjacent projections and being sized to accommodate a portion of a finger of a workman;

a slot formed adjacent one of said notches and extending into said plate-like member substantially to the center thereof for engagement with said flat segment of said threaded member, and a handle adapted to be secured to said plate-like member for increasing the amount of leverage that can be applied to said wrench.

2. The wrench of claim 1 wherein said handle is friction fitted over one of said plurality of projections.

3. The wrench of claim 1 wherein said plate-like member is disc shaped and said slot extends into said member a distance substantially equivalent to the radius of the same.

4. The wrench of claim 1 wherein said two adjacent projections diverge from one another for facilitating the engagement of said slot with said flat segment.

5. The wrench of claim 1 wherein said slot has an elongated U-shape.

6. A manual wrench for engaging a threaded member having a flat segment comprising:

a plate-like member;

a plurality of substantially equally spaced projections extending around the periphery of said plate-like member;

a slot formed between two adjacent projections and extending into said plate-like member substantially to the center thereof for engagement with said flat segment of said threaded member, and a handle friction fitted over one of said plurality of projections of said plate-like member for increasing the amount of leverage that can be applied to said wrench.

* * * * *